US006086108A

United States Patent [19]

Rosenberger

[11] Patent Number: 6,086,108

[45] Date of Patent: Jul. 11, 2000

[54] CONTROLLED SUBSTANCE DISPENSING FORM

[75] Inventor: Philip James Rosenberger, Jacksonville, Fla.

[73] Assignee: The Standard Register Company, Dayton, Ohio

[21] Appl. No.: 09/228,605

[22] Filed: Jan. 12, 1999

[51] Int. Cl.[7] ..... B42D 15/00; B65D 69/00

[52] U.S. Cl. ..... 283/81; 283/101; 283/105; 283/900; 206/232; 206/459; 462/28; 462/25

[58] Field of Search ..... 283/81, 101, 105, 283/900; 462/28, 39, 25, 22; 428/42.2, 42.3; 206/232, 459

[56] References Cited

U.S. PATENT DOCUMENTS

| | | | |
|---|---|---|---|
| 3,773,250 | 11/1973 | Phillips | 229/69 |
| 4,159,129 | 6/1979 | Lockhart | 282/27 R |
| 4,191,402 | 3/1980 | Michlin | 282/23 R |
| 4,720,479 | 1/1988 | Craig et al. | 503/200 |
| 4,976,351 | 12/1990 | Mangini et al. | 206/232 |
| 5,048,870 | 9/1991 | Mangini et al. | 283/81 |
| 5,299,979 | 4/1994 | Ballard | 462/18 |
| 5,393,100 | 2/1995 | Coe | 283/115 |
| 5,395,288 | 3/1995 | Linden et al. | 462/18 |
| 5,435,600 | 7/1995 | Griffiths et al. | 283/81 |
| 5,580,640 | 12/1996 | Kraft et al. | 428/195 |
| 5,632,842 | 5/1997 | Oliver et al. | 156/268 |
| 5,637,369 | 6/1997 | Stewart | 428/42.3 |
| 5,752,722 | 5/1998 | Moore et al. | 283/81 |
| 5,799,981 | 9/1998 | Tung et al. | 283/56 |
| 5,807,623 | 9/1998 | Chess | 428/195 |
| 5,819,665 | 10/1998 | McCormick | 101/483 |
| 5,863,629 | 1/1999 | Kuo et al. | 428/40.1 |
| 5,899,504 | 5/1999 | Fabel | 283/109 |

*Primary Examiner*—Willmon Fridie, Jr.
*Assistant Examiner*—Alisa L. Thurston
*Attorney, Agent, or Firm*—Killworth, Gottman, Hagan & Schaeff, LLP

[57] ABSTRACT

A controlled substance dispensing form is provided. The form includes a face sheet, a liner ply, an imaging interface interposed between the face sheet and the liner ply, and an adhesive interposed between the face sheet and the liner ply. In accordance with one embodiment of the present invention, a controlled substance dispensing form is provided comprising a face sheet, a liner ply, an imaging interface interposed between the face sheet and the liner ply, and an adhesive interposed between the face sheet and the liner ply to secure the face sheet to the liner ply. The liner ply is configured to define an upper liner ply surface, a lower liner ply surface, and a plurality of releasable liner ply portions. The adhesive is configured to define respective reusable adhesive portions. The face sheet is configured to define an upper face sheet surface and a lower face sheet surface and a plurality of label portions. The reusable adhesive portions are positioned to releasably adhere corresponding ones of the plurality of label portions to corresponding ones of the plurality of releasable liner ply portions. The reusable adhesive portions and the releasable liner ply portions are configured such that the reusable adhesive portions retain their properties of adhesion following release from the corresponding releasable liner ply portions. The imaging interface is configured such that an image impression made on the upper face sheet surface in one of the plurality of label portions creates a duplicate image on the upper liner ply surface.

20 Claims, 3 Drawing Sheets

CONTROLLED SUBSTANCE DISPENSING FORM

BACKGROUND OF THE INVENTION

The present invention relates to a form for facilitating the dispensing of controlled substances. Forms of this type are commonly used by hospitals to dispense and track the use of federally controlled narcotics.

Hospitals and other authorities are commonly required to provide a strict accounting of the disposition of controlled substances, e.g., narcotics such as morphine and cocaine. One type of form commonly used by hospitals to account for controlled substances is best described as a shingled narcotic form set. The shingled form comprises a base ledger sheet made up of rows and columns. Glued at the top of the sheet is a short ply receipt portion. Below the receipt portion are glued approximately 25 short sheets or tickets. The short sheets are shingled so that the top line of each ticket is mated with a single row on the ledger. Each form ply has a matching form number. On each ticket are pre-printed code numbers and names of approximately 40 controlled substances. A form is used for each controlled drug packet dispensed. Drugs come packed in various dose quantities, e.g., 10, 15, or 25 doses. Each ticket represents a single dose.

According to a typical scenario for utilizing the shingled narcotic form set, when a nursing station uses up their last dosage of "Cocaine Topical Solution," a nurse sends the spent ledger card down to the hospital pharmacy, and requests a re-order for a packet containing 25 doses. The pharmacist fills-in the top receipt portion of the form, listing "8076—Cocaine Topical Solution" as the drug. The pharmacist runs a highlighter through this pre-printed name down through the 25 shingled tickets and sends the drug along with the form to the nursing station. The nursing station places the form in a 3-ring notebook for controlled substances.

Next, Dr. Smith prescribes for patient Jane Jones, one dose, 4×day of Cocaine Topical Solution. Nurse Barnes fills out the top portion of a ticket with the patient information etc., which also yields a carbonless image on the ledger. The nurse then pulls the ticket from the ledger, runs it through an Addressograph with the patient's billing information, and places it in a stack of other tickets. Jane Jones gets the dose. Dr. Quinn prescribes Cocaine Topical Solution to John Doe. This information goes on the same form. John Doe gets the cocaine, and this information is recorded on ticket #2. Each dose is handled this way. Even wasted doses use a ticket. If a ½ dose is prescribed, the other ½ is reported as a fractional waste dose. There is a further portion of the form to list discrepancies and explanations. At the end of a shift, a whole stack of imprinted tickets are sent down to the pharmacy for billing. The pharmacist has to key each ticket in individually. When all doses have been dispensed, the journal card goes back to the pharmacy to re-supply the nursing station.

The shingled narcotic form set is very expensive to produce, and is very labor intensive for the forms user. Multiple handwritten entries are made, and information from the ledger and tickets must be separately keyed to a computer, lending this process readily open to human error. Accordingly, there is a need for an improved controlled substance dispensing form that is cost-effective to produce, minimizes the amount of time a forms user must set aside to actually use the form, alleviates the need for multiple handwritten entries, and minimizes human error by eliminating the need for separate manual data entry and automated data entry operations.

BRIEF SUMMARY OF THE INVENTION

This need is met by the present invention wherein a controlled substance dispensing form is provided. The form includes a face sheet, a liner ply, an imaging interface interposed between the face sheet and the liner ply, and an adhesive interposed between the face sheet and the liner ply.

In accordance with one embodiment of the present invention, a controlled substance dispensing form is provided comprising a face sheet, a liner ply, an imaging interface interposed between the face sheet and the liner ply, and an adhesive interposed between the face sheet and the liner ply to secure the face sheet to the liner ply. The liner ply is configured to define an upper liner ply surface, a lower liner ply surface, and a plurality of releasable liner ply portions. The adhesive is configured to define respective reusable adhesive portions. The face sheet is configured to define an upper face sheet surface and a lower face sheet surface and a plurality of label portions. The reusable adhesive portions are positioned to releasably adhere corresponding ones of the plurality of label portions to corresponding ones of the plurality of releasable liner ply portions. The reusable adhesive portions and the releasable liner ply portions are configured such that the reusable adhesive portions retain their properties of adhesion following release from the corresponding releasable liner ply portions. The imaging interface is configured such that an image impression made on the upper face sheet surface in one of the plurality of label portions creates a duplicate image on the upper liner ply surface.

According to an alternative embodiment of the present invention, the liner ply is further configured to define a laminated liner ply portion. The adhesive is further configured to define a laminating adhesive portion. The face sheet is further configured to define a return receipt portion demarcated from a remainder of the face sheet by a line of perforation to enable separation of the return receipt portion from the remainder of the face sheet. The laminating adhesive portion is positioned to secure the return receipt portion to the laminated liner ply portion and the laminated liner ply portion is configured to adhere to the laminating adhesive portion with an adhesion strength substantially greater than an adhesion strength of the respective releasable liner ply portions to the corresponding reusable adhesive portions.

The face sheet may be configured to further define a header portion, and the laminating adhesive portion may comprise a first laminating adhesive portion in registration with the return receipt portion and a second laminating adhesive portion in registration with the header portion. The return receipt portion may include encoded printed indicia. The header portion may include a duplicate of the encoded printed indicia and individual ones of the label portions may include respective further duplicates of the encoded printed indicia. Alternatively, the return receipt portion may include identifying indicia, wherein the header portion includes a duplicate of the identifying indicia, and wherein individual ones of the label portions include respective further duplicates of the identifying indicia. Further, the return receipt portion may include controlled substance identifying indicia, wherein the header portion includes a duplicate of the controlled substance identifying indicia, and wherein individual ones of the label portions include respective further duplicates of the controlled substance identifying indicia.

The plurality of label portions may be demarcated in the face sheet by an array of die cuts in the face sheet. Individual ones of the label portions may be secured to adjacent label portions via a face sheet tie, wherein the face sheet tie comprises a portion of the face sheet defined between adjacent die cuts in the array of die cuts.

The reusable adhesive portions may be configured to define a bonded label portion and an un-bonded label portion in individual ones of the plurality of label portions. The duplicate image may be created in a portion of the upper liner ply surface positioned in registration with the un-bonded label portion. The form may further comprise back printing on the lower liner ply surface, wherein the back printing defines data entry portions positioned out of registration with the un-bonded label portion.

The imaging interface may comprise a CB coating applied to the lower face sheet surface and a CF coating applied to the upper liner ply surface. The CB coating may comprise a substantially full coat or a pattern coat across the lower face sheet surface. Similarly, the CF coating may comprise a full coat or a pattern coat across the upper liner ply surface.

The return receipt portion may include encoded printed indicia and individual ones of the label portions may include respective duplicates of the encoded printed indicia. The return receipt portion may also include identifying indicia and individual ones of the label portions may include respective duplicates of the identifying indicia. The return receipt portion may further include controlled substance identifying indicia and individual ones of the label portions may include respective duplicates of the controlled substance identifying indicia.

According to an alternative embodiment of the present invention, the liner ply is further configured to define a laminated liner ply portion, the adhesive is further configured to define a laminating adhesive portion, the face sheet is further configured to define a header portion, the laminating adhesive portion is positioned to secure the header portion to the laminated liner ply portion, and the laminated liner ply portion is configured to adhere to the laminating adhesive portion with an adhesion strength substantially greater than an adhesion strength of the respective releasable liner ply portions to the corresponding reusable adhesive portions.

The header portion may include encoded printed indicia and individual ones of the label portions may include respective duplicates of the encoded printed indicia. The header portion may also include identifying indicia and individual ones of the label portions may include respective duplicates of the identifying indicia. The header portion may further include controlled substance identifying indicia and individual ones of the label portions may include respective duplicates of the controlled substance identifying indicia.

In accordance with another embodiment of the present invention, a controlled substance dispensing form is provided comprising a face sheet, a liner ply, an imaging interface interposed between the face sheet and the liner ply, and an adhesive interposed between the face sheet and the liner ply to secure the face sheet to the liner ply. The liner ply is configured to define an upper liner ply surface, a lower liner ply surface, and a releasable liner ply portion. The adhesive is configured to define respective reusable adhesive portions. The face sheet is configured to define an upper face sheet surface, a lower face sheet surface, and a plurality of label portions. The reusable adhesive portion is configured to releasably adhere respective ones of the plurality of label portions to the releasable liner ply portion. The reusable adhesive portion and the releasable liner ply portion are configured such that the reusable adhesive portion retains its properties of adhesion following release from the releasable liner ply portion. The imaging interface is configured such that an image impression made on the upper face sheet surface in one of the plurality of label portions creates a duplicate image on the upper liner ply surface.

The reusable adhesive portion may comprise a substantially full coat adhesive across the lower face sheet surface. Similarly, the imaging interface may comprise a substantially full coat imaging interface across the upper liner ply surface and the releasable liner ply portion may comprise a substantially full coat release interface interposed between the reusable adhesive portion and the liner ply portion. The imaging interface may comprise a self-contained carbonless coating. The release interface may comprise a silicone release layer and a polyethylene film applied across the imaging interface.

In accordance with yet another embodiment of the present invention, a business form is provided comprising a face sheet, a CB coating, a CF coating, and a reusable adhesive interface. The face sheet defines an upper face sheet surface and a lower face sheet surface. The liner ply defines an upper liner ply surface and a lower liner ply surface. The CB coating is applied to the lower face sheet surface. The CF coating is applied to the upper liner ply surface, wherein the CF coating is positioned to interface with the CB coating such that an image impression made on the upper face sheet surface in one of the plurality of label portions creates a duplicate image on the upper liner ply surface. The reusable adhesive interface is interposed between the lower face sheet surface and the upper liner ply surface such that the face sheet is releasably adhered to the liner ply.

The reusable adhesive interface may comprise a release layer and an adhesive layer. The adhesive layer may be applied to the lower face sheet surface. The release layer may be applied to the upper liner ply surface. The CB coating may be interposed between the adhesive interface and the lower face sheet surface. The CF coating may be interposed between the adhesive interface and the upper liner ply surface.

Accordingly, it is an object of the present invention to provide an improved form for facilitating the dispensing of controlled substances. Other objects of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
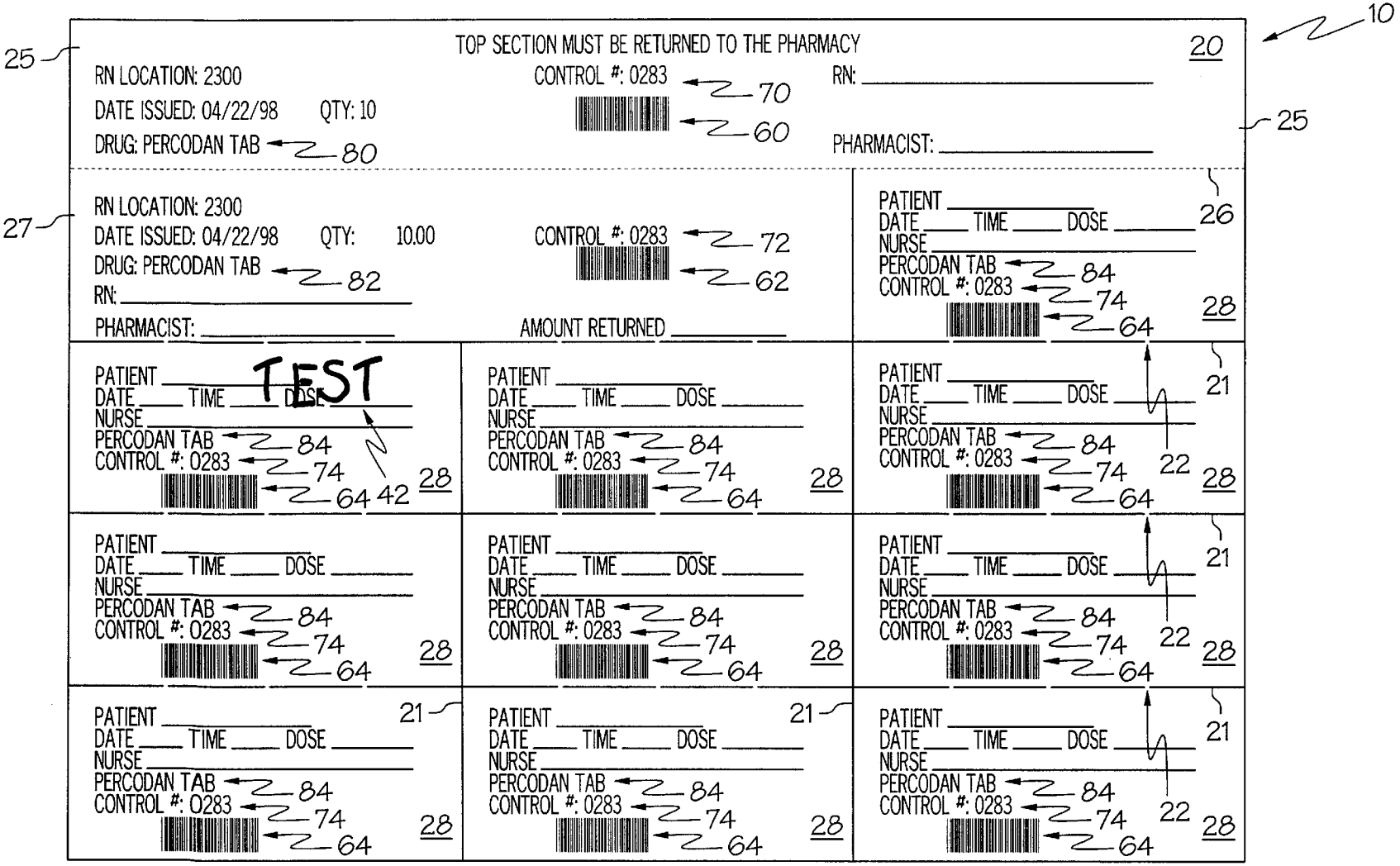
FIG. 1 is a plan view of a controlled substance dispensing form according to the present invention.
Figure 2:
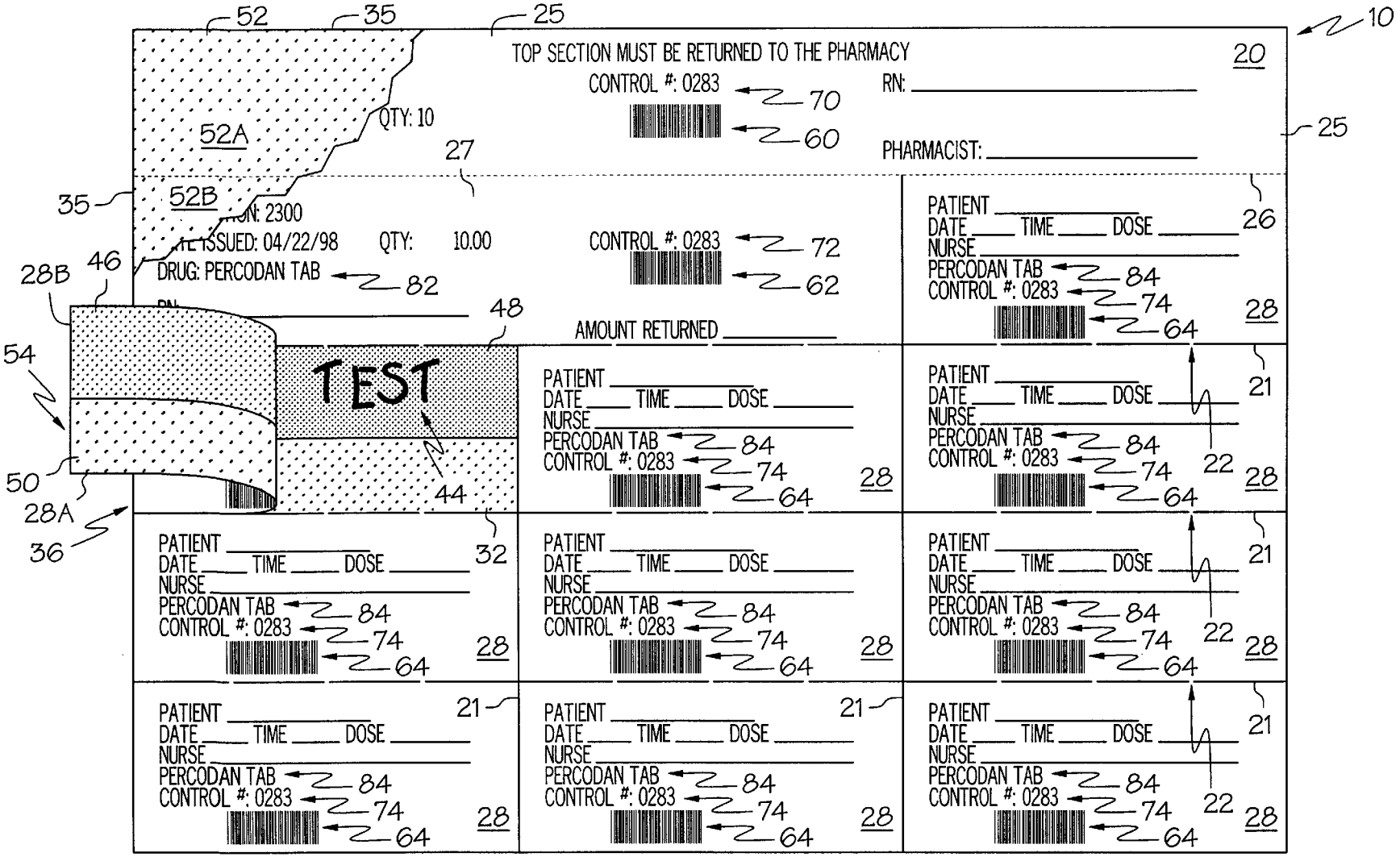
FIG. 2 is a plan view of the controlled substance dispensing form of FIG. 1 with a partially peeled back label portion.
Figure 3:
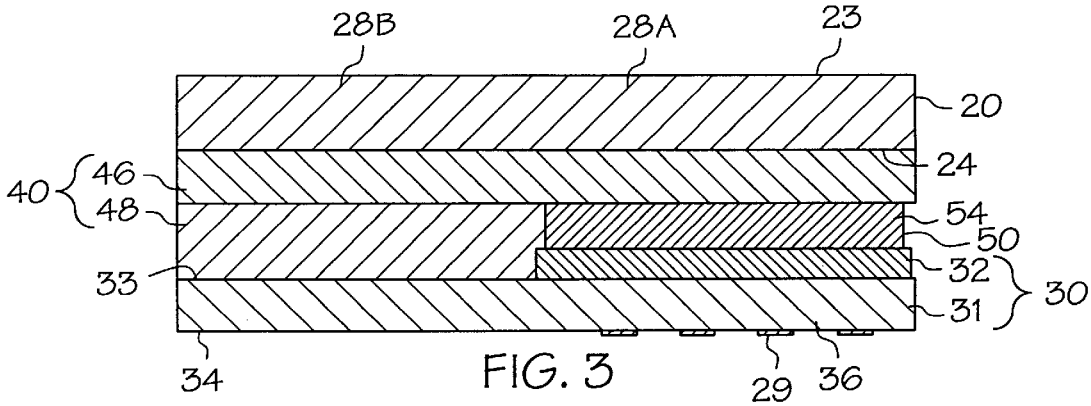
FIG. 3 is a schematic cross-sectional illustration of a portion of a controlled substance dispensing form according to the present invention.

Referring initially to FIGS. 1–3, a controlled substance dispensing form 10 according to the present invention is illustrated. The controlled substance dispensing form 10 comprises a face sheet 20, a liner ply 30, an imaging interface 40 interposed between the face sheet 20 and the liner ply 30, and an adhesive 50 interposed between the face sheet 20 and the liner ply 30 to secure the face sheet 20 to the liner ply 30. The liner ply 30 includes a base ply 31 and a patterned adhesive release layer 32, and is configured to define an upper liner ply surface 33 and a lower liner ply surface 34, a laminated liner ply portion 35, and a plurality of releasable liner ply portions 36.

The face sheet 20 is configured to define an upper face sheet surface 23 and a lower face sheet surface 24. A return receipt portion 25 is demarcated from a remainder of the face sheet 20 by a line of perforation 26 to enable separation of the return receipt portion 25 from the remainder of the face sheet 20. The face sheet 20 is further configured to define a plurality of distinct label portions 28 demarcated in the face sheet 20 by an array of die cuts 21 in the face sheet 20. Individual ones of the label portions 28 are secured to adjacent label portions via a plurality of face sheet ties 22. The face sheet ties 22 are actually portions of the face sheet 20 defined between adjacent die cuts 21 in the array of die cuts 21.

The adhesive 50 is configured to define a laminating adhesive portion 52 and respective reusable adhesive portions 54. The laminating adhesive portion 52 is positioned to secure the return receipt portion 25 to the laminated liner ply portion 35. The reusable adhesive portions 54 are positioned to releasably adhere corresponding ones of the plurality of label portions 28 to corresponding ones of the plurality of releasable liner ply portions 36. The reusable adhesive portions 54 and the releasable liner ply portions 36 are configured such that the reusable adhesive portions 54 retain their properties of adhesion following release from the corresponding releasable liner ply portions 36.

The laminated liner ply portion 35 is configured to adhere to the laminating adhesive portion 52 with an adhesion strength substantially greater than an adhesion strength of the respective releasable liner ply portions 36 to the corresponding reusable adhesive portions 54. In this manner, the controlled substance dispensing form 10 encourages separation of the label portions 28 from the releasable liner ply portions 36 while preventing inadvertent separation of the laminated liner ply portion 35 and the laminating adhesive portion 52.

Referring again to FIGS. 1 and 2, the face sheet 20 is further configured to define a header portion 27. The laminating adhesive portion 52 comprises a first laminating adhesive portion 52A in registration with the return receipt portion 25 and a second laminating adhesive portion 52B in registration with the header portion 27. In one embodiment of the present invention, the return receipt portion 25 includes encoded printed indicia 60, the header portion 27 includes a duplicate 62 of the encoded printed indicia 60, and individual ones of the label portions 28 include respective further duplicates 64 of the encoded printed indicia 60. Additionally, according to another aspect of the present invention, the return receipt portion 25 includes identifying indicia 70, e.g., a control number. The header portion includes a duplicate 72 of the identifying indicia 70 and individual ones of the label portions 28 include respective further duplicates 74 of the identifying indicia 70. Finally, according to yet another aspect of the present invention, the return receipt portion 25 includes controlled substance identifying indicia 80, the header portion includes a duplicate 82 of the controlled substance identifying indicia 80, and individual ones of the label portions 28 include respective further duplicates 84 of the controlled substance identifying indicia 80.

Referring additionally to FIG. 3, the imaging interface 40 is configured such that an image impression 42 made on the upper face sheet surface 23 in one of the plurality of label portions 28 creates a duplicate image 44 on the upper liner ply surface 33. The reusable adhesive portions 54 are configured to define a bonded label portion 28A and an un-bonded label portion 28B in individual ones of the plurality of label portions 28. The duplicate image 44 is created in a portion of the upper liner ply surface 33 positioned in registration with the un-bonded label portion 28B. Back printing 29 on the lower liner ply surface 34 is configured to define data entry portions positioned out of registration with the un-bonded label portion 28B. In this manner, a specific data entry made on the lower liner ply surface 34, i.e., the back of the form 10, would not create an inadvertent duplicate image on the upper liner ply surface 33 because the data entry portions defined by the back printing are not in registration with the imaging interface 40 in the un-bonded label portions 28B. Although the specific configuration of the back printing is not illustrated in the drawings, as would be appreciated by those practicing the present invention, the back printing 29 would typically comprise empty printed boxes, fill-in lines, etc.

As is clearly illustrated in FIGS. 1–3, the header portion 27 is defined within the face sheet 20. Stated differently, the upper surface of the header portion 27 is formed from a portion of the upper surface 23 of the face sheet 20. As is noted above, the return receipt portion 25 is demarcated within the face sheet 20 in the same fashion. Similarly, as is clearly illustrated in FIG. 3, the label portions 28 are defined within the face sheet 20 such that respective upper surfaces of the label portions 28 are formed from corresponding portions of the upper surface 23 of the face sheet 20.

Figure 4:
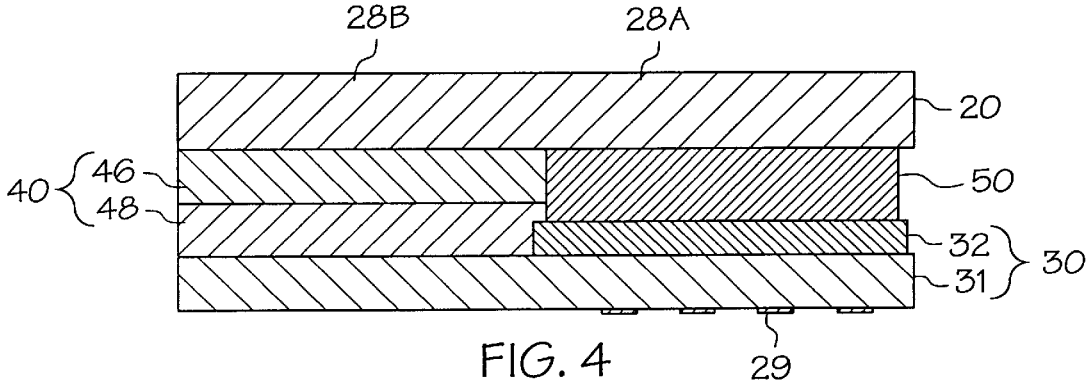
FIG. 4 is a schematic cross-sectional illustration of a portion of a controlled substance dispensing form according to one embodiment of the present invention.
Figure 6:
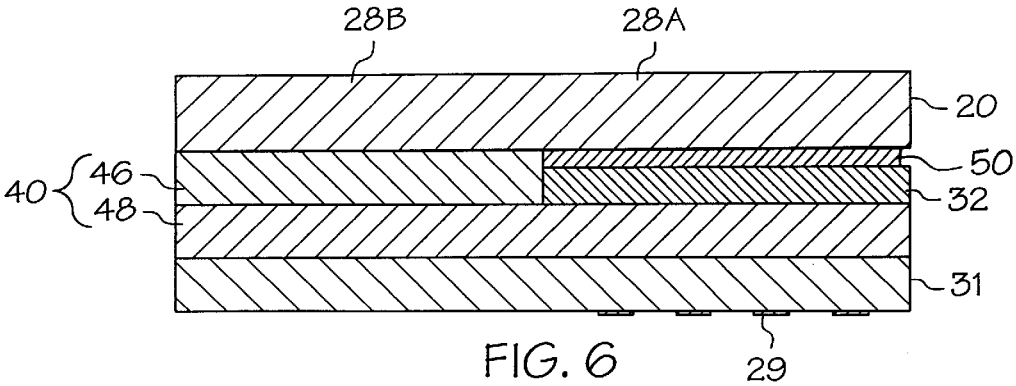
FIG. 6 is a schematic cross-sectional illustration of a portion of a controlled substance dispensing form according to a further alternative embodiment of the present invention.

The imaging interface 40 illustrated in FIGS. 3, 4, and 6 comprises a CB coating 46 applied to the lower face sheet surface 24 and a CF coating 48 applied to the upper liner ply surface 33. The CB coating 46 may comprise a substantially full coat across the lower face sheet surface 24 (see FIG. 3) or a pattern coat across the lower face sheet surface 24 (see FIG. 4). Similarly, The CF coating 48 may comprise a substantially full coat across the upper liner ply surface 33 (see FIG. 6) or a pattern coat across the upper liner ply surface 33 (see FIGS. 3 and 4). As will be appreciated by those skilled in the art, CB and CF refer to commercially available carbonless back (CB) and carbonless front (CF) coatings. The CF coating 48 on the upper liner ply surface 33 is positioned in registration with the CB coating 46 on the lower face sheet surface 24. The CB and CF coatings 46, 48 complement each other such that, when physical impressions are made on a surface having a CB coated back, a duplicate image is created on the underlying surface coated with the CF solution. In this manner, impressions made through printing on the upper face sheet surface 23 are duplicated on the upper liner ply surface 33. More specifically, the CF coating 48 and the CB coating 46 are configured to (i) permit a user of the dispensing form 10 to indicate on the upper label portion 28 conditions of an substance dispensing activity in the form of the image impression 42 and (ii) enable simultaneous creation of the duplicate image 44 on the upper liner ply surface 33.

Figure 5:
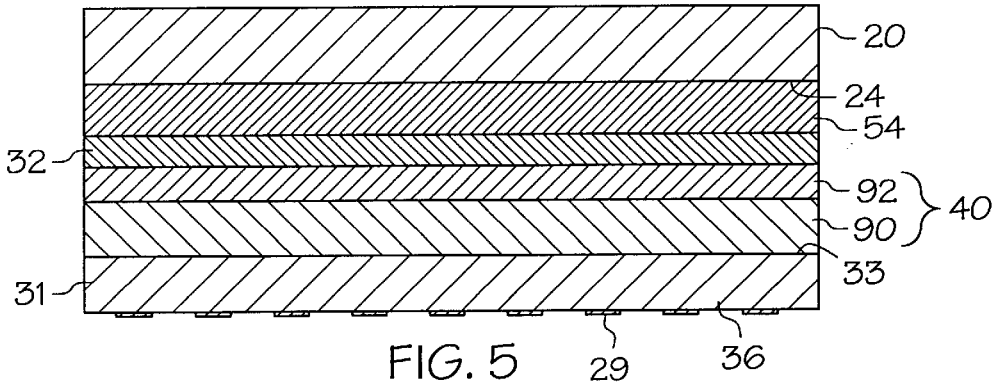
FIG. 5 is a schematic cross-sectional illustration of a portion of a controlled substance dispensing form according to an alternative embodiment of the present invention.

The present invention is not limited to specific CB and CF compositions. Rather, any compositions functioning in this manner or in a substantially equivalent manner are contemplated by the present invention. An example of contemplated equivalent structure is illustrated in FIG. 5, where the CF and CB coatings would be replaced with an imaging interface 40 including a single self contained carbonless coating 90 and a polyethylene film coating 92. The polyethylene film coating 92 serves to protect the self-contained carbonless coating from adverse reactions with the silicone coating. For the purposes of describing and defining the present invention, carbonless coatings comprise any imaging interface or coating that does not require that a conventional carbon sheet be interposed between the layer to receive the original image and the layer to receive the duplicate image.

Referring further to FIG. 5, it is noted that the reusable adhesive portion 54 may comprise a substantially full coat adhesive across the lower face sheet surface 24 and the releasable liner ply portion 36 may comprise a substantially full coat release interface interposed between the reusable adhesive portion 54 and the upper liner ply surface 33. Further, the imaging interface 40 may comprise a substantially full coat imaging interface across the upper liner ply surface 33.

According to a typical scenario for using the controlled substance dispensing form 10 of the present invention, the hospital pharmacy is asked to send a packet of 25 doses of "Percodan" to a nursing station. A computer system containing software such as that supplied by Cerner of Kansas City, Mo., under the product name Cerner Classic Clinical Information System, Pharmnet Module, directs the printer to print a blank form with receipt information, and drug information in both text and bar code format. At least 25 labels portions 28 are printed with duplicate drug information, including pre-printed-type areas for subsequent handwritten data entry that will yield carbonless images on the liner ply 30.

The nursing station receives the packet and form 10. The receipt portion 25 is torn off at the perf 26 and is returned to the pharmacy. The pharmacy wands the bar code, confirming the floor received the drugs. Dr. Smith prescribes for Jane Jones one dose, 4×/day of Percodan. Nurse Barnes fills out the first label 28 with the nurse's name, the patient's name, date, time, etc., which gets impressed on to the liner ply 30. The nurse sticks the label 28 on Jane Jones' charge sheet. Jane's charge sheet preferably has a bar code. All the different medications for Jane Jones will go on one sheet. Daily, this sheet goes to the pharmacy for charging. Bringing up Jane Jones on the computer one time, the pharmacist wands Jane's bar code, then wands everything on the sheet and the billing is done for Jane. The nursing station retains the form 10 with the return receipt portion 25 removed and with header portion 27 still permanently affixed to the form 10. When all dosages are gone, the form 10 is returned to the pharmacy for replenishment of supply.

The back side of the liner ply 30 has pre-printed, an area for documenting and explaining wasted medications and discrepancies. It is important the labels are removed opposite areas of entering waste information on the back side. Otherwise, a reverse image will inadvertently be formed in the CF area opposite the waste data entry. The back printing can be arranged for data entry in such a way that the impact printing will only be recorded in areas opposite the adhesive areas. This alleviates any inadvertent imaging in the carbonless areas. Impact printing is preferably done by handwriting, but alternately may be impressed with a typewriter, or other impact printing device.

Having described the invention in detail and by reference to preferred embodiments thereof, it will be apparent that modifications and variations are possible without departing from the scope of the invention defined in the appended claims.

What is claimed is:

1. A controlled substance dispensing form comprising a face sheet, a liner ply, an imaging interface interposed between said face sheet and said liner ply, and an adhesive interposed between said face sheet and said liner ply to secure said face sheet to said liner ply, wherein:

said liner ply is configured to define an upper liner ply surface and a lower liner ply surface, and a plurality of releasable liner ply portions;

said adhesive is configured to define respective reusable adhesive portions;

said face sheet is configured to define an upper face sheet surface and a lower face sheet surface, wherein a header portion is defined within said face sheet such that an upper surface of said header portion is formed from a portion of said upper surface of said face sheet, and a plurality of label portions are defined within said face sheet such that respective upper surfaces of said label portions are formed from corresponding portions of said upper surface of said face sheet;

said reusable adhesive portions are positioned to releasably adhere corresponding ones of said plurality of label portions to corresponding ones of said plurality of releasable liner ply portions;

said reusable adhesive portions and said releasable liner ply portions are configured such that said reusable adhesive portions retain their properties of adhesion following release from said corresponding releasable liner ply portions; and said imaging interface is configured such that, in each of said plurality of label portions, an image impression made on said upper face sheet surface in one of said plurality of label portions creates a duplicate image on said upper liner ply surface in one of said plurality of releasable liner ply portions.

2. A controlled substance dispensing form comprising a face sheet, a liner ply, an imaging interface interposed between said face sheet and said liner ply, and an adhesive interposed between said face sheet and said liner ply to secure said face sheet to said liner ply, wherein:

said liner ply is configured to define an upper liner ply surface and a lower liner ply surface, a plurality of releasable liner ply portions, and a laminated liner ply portion;

said adhesive is configured to define a laminating adhesive portion and respective reusable adhesive portions;

said face sheet is configured to define an upper face sheet surface and a lower face sheet surface, wherein a return receipt portion is demarcated from a remainder of said face sheet by a line of perforation to enable separation of said return receipt portion from said remainder of said face sheet, said return receipt portion is defined within said face sheet such that an upper surface of said return receipt portion is formed from a portion of said upper surface of said face sheet, said laminating adhesive portion is positioned to secure said return receipt portion to said laminated liner ply portion, a plurality of label portions are defined within said face sheet such that respective upper surfaces of said label portions are formed from corresponding portions of said upper surface of said face sheet;

said reusable adhesive portions are positioned to releasably adhere corresponding ones of said plurality of label portions to corresponding ones of said plurality of releasable liner ply portions;

said reusable adhesive portions and said releasable liner ply portions are configured such that said reusable adhesive portions retain their properties of adhesion following release from said corresponding releasable liner ply portions; and said imaging interface is configured such that, in each of said plurality of label portions, an image impression made on said upper face sheet surface in one of said plurality of label portions creates a duplicate image on said upper liner ply surface in one of said plurality of releasable liner ply portions.

3. A controlled substance dispensing form as claimed in claim 2 wherein said face sheet is configured to further define a header portion, and wherein said laminating adhesive portion comprises a first laminating adhesive portion in registration with said return receipt portion and a second laminating adhesive portion in registration with said header portion.

4. A controlled substance dispensing form as claimed in claim 3 wherein said return receipt portion includes encoded printed indicia, wherein said header portion includes a duplicate of said encoded printed indicia, and wherein individual ones of said label portions include respective further duplicates of said encoded printed indicia.

5. A controlled substance dispensing form as claimed in claim 3 wherein said return receipt portion includes identifying indicia, wherein said header portion includes a duplicate of said identifying indicia, and wherein individual ones of said label portions include respective further duplicates of said identifying indicia.

6. A controlled substance dispensing form as claimed in claim 3 wherein said return receipt portion includes controlled substance identifying indicia, wherein said header portion includes a duplicate of said controlled substance identifying indicia, and wherein individual ones of said label portions include respective further duplicates of said controlled substance identifying indicia.

7. A controlled substance dispensing form comprising a face sheet, a liner ply, an imaging interface interposed between said face sheet and said liner ply, and an adhesive interposed between said face sheet and said liner ply to secure said face sheet to said liner ply, wherein:

said liner ply is configured to define an upper liner ply surface and a lower liner ply surface, a plurality of releasable liner ply portions, and a laminated liner ply portion;

said adhesive is configured to define respective reusable adhesive portions and a laminating adhesive portion;

said face sheet is configured to define an upper face sheet surface and a lower face sheet surface said reusable adhesive portions and said releasable liner ply portions are configured such that said reusable adhesive portions retain their properties of adhesion following release from said corresponding releasable liner ply portions;

said imaging interface is configured such that, in each of said plurality of label portions, an image impression made on said upper face sheet surface in one of said plurality of label portions creates a duplicate image on said upper liner ply surface in one of said plurality of releasable liner ply portions;

said plurality of label portions are demarcated in said face sheet by an array of die cuts in said face sheet; and individual ones of said label portions are secured to adjacent label portions via a face sheet tie, wherein said face sheet tie comprises a portion of said face sheet defined between adjacent die cuts in said array of die cuts.

8. A controlled substance dispensing form comprising a face sheet, a liner ply, an imaging interface interposed between said face sheet and said liner ply, and an adhesive interposed between said face sheet and said liner ply to secure said face sheet to said liner ply, wherein:

said liner ply is configured to define an upper liner ply surface and a lower liner ply surface and a plurality of releasable liner ply portions;

said adhesive is configured to define respective reusable adhesive portions;

said face sheet is configured to define an upper face sheet surface and a lower face sheet surface said reusable adhesive portions and said releasable liner ply portions are configured such that said reusable adhesive portions retain their properties of adhesion following release from said corresponding releasable liner ply portions;

said imaging interface is configured such that, in each of said plurality of label portions, an image impression made on said upper face sheet surface in one of said plurality of label portions creates a duplicate image on said upper liner ply surface in one of said plurality of releasable liner ply portions;

said reusable adhesive portions are configured to define a bonded label portion and an un-bonded label portion in individual ones of said plurality of label portions, and wherein said duplicate image is created in a portion of said upper liner ply surface positioned in registration with said un-bonded label portion; and back printing on said lower liner ply surface defines data entry portions positioned out of registration with said un-bonded label portion.

9. A controlled substance dispensing form as claimed in claim 1 wherein said imaging interface comprises a CB coating applied to said lower face sheet surface and a CF coating applied to said upper liner ply surface.

10. A controlled substance dispensing form as claimed in claim 9 wherein said CB coating comprises a substantially full coat across said lower face sheet surface.

11. A controlled substance dispensing form as claimed in claim 9 wherein said CB coating comprises a pattern coat across said lower face sheet surface.

12. A controlled substance dispensing form as claimed in claim 9 wherein said CF coating comprises a pattern coat across said upper liner ply surface.

13. A controlled substance dispensing form as claimed in claim 9 wherein said CF coating comprises a full coat across said upper liner ply surface.

14. A controlled substance dispensing form as claimed in claim 2 wherein said return receipt portion includes encoded printed indicia and wherein individual ones of said label portions include respective duplicates of said encoded printed indicia.

15. A controlled substance dispensing form as claimed in claim 2 wherein said return receipt portion includes identifying indicia and wherein individual ones of said label portions include respective duplicates of said identifying indicia.

16. A controlled substance dispensing form as claimed in claim 2 wherein said return receipt portion includes controlled substance identifying indicia and wherein individual ones of said label portions include respective duplicates of said controlled substance identifying indicia.

17. A controlled substance dispensing form as claimed in claim 1 wherein said header portion includes encoded printed indicia and wherein individual ones of said label portions include respective duplicates of said encoded printed indicia.

18. A controlled substance dispensing form as claimed in claim 1 wherein said header portion includes identifying indicia and wherein individual ones of said label portions include respective duplicates of said identifying indicia.

19. A controlled substance dispensing form as claimed in claim 1 wherein said header portion includes controlled substance identifying indicia and wherein individual ones of said label portions include respective duplicates of said controlled substance identifying indicia.

20. A controlled substance dispensing form comprising a face sheet, a liner ply, an imaging interface interposed between said face sheet and said liner ply, and an adhesive interposed between said face sheet and said liner ply to secure said face sheet to said liner ply, wherein:

said liner ply is configured to define an upper liner ply surface and a lower liner ply surface and a plurality of releasable liner ply portions;

said face sheet is configured to define an upper face sheet surface and a lower face sheet surface, wherein a plurality of label portions are defined within said face sheet such that respective upper surfaces of said label portions are formed from corresponding portions of said upper surface of said face sheet;

said adhesive is configured to define respective reusable adhesive portions within each of said plurality of label portions;

each of said reusable adhesive portions are positioned to releasably adhere corresponding ones of said plurality of label portions to corresponding ones of said plurality of releasable liner ply portions;

said reusable adhesive portions and said releasable liner ply portions are configured such that said reusable adhesive portions retain their properties of adhesion following release from said corresponding releasable liner ply portions;

each of said reusable adhesive portions are configured to define a bonded label portion and an un-bonded label portion in individual ones of said plurality of label portions; and said imaging interface, said adhesive and said releasable liner ply portions are configured such that, in each of said plurality of label portions, an image impression made on said upper face sheet surface in one of said plurality of label portions creates a duplicate image on said upper liner ply surface in one of said plurality of releasable liner ply portions and said duplicate image is created in a portion of said upper liner ply surface positioned in registration with said un-bonded label portion.

* * * * *

UNITED STATES PATENT AND TRADEMARK OFFICE

CERTIFICATE OF CORRECTION

PATENT NO. : 6,086,108
DATED : July 11, 2000
INVENTOR(S) : Philip James Rosenberger It is certified that error appears in the above-identified patent and that said Letters Patent is hereby corrected as shown below:

Column 8,
Line 38, "that, in each of said" should read -- that, in said --.

Column 9,
Line 14, "that, in each of said" should read -- that, in said --.

Column 9,
Line 65, "that, in each of said" should read -- that, in said --.

Column10,
Line 30, "that, in each of said" should read -- that, in said --.

Column 12,
Line 6, "within each of said" should read -- within said --.
Line 24, ""that, in each of said" should read -- that, in said --.

UNITED STATES PATENT AND TRADEMARK OFFICE

CERTIFICATE OF CORRECTION

PATENT NO. : 6,086,108
DATED : July 11, 2000
INVENTOR(S) : Philip James Rosenberger It is certified that error appears in the above-identified patent and that said Letters Patent is hereby corrected as shown below:

Column 12,

Line 24, "portions, an image impression" should read -- portions;

each of said resuable adhesive portions are positioned to releasably adhere corresponding ones of said plurality of label portions to corresponding ones of said plurality of releasable liner ply portions;

said reusable adhesive portions and said releasable liner ply portions are configured such that said reusable adhesive portions retain their properties of adhesion following release from said corresponding releasable liner ply portions;

each of said reusable adhesive portions are configured to define a bonded label portion and an un-bonded lael portion in individual ones of said plurality of label portions; and said imaging interface, said adhesive and said releasable liner ply portions are configured such that, in said plurality of label portions, --

Signed and Sealed this

Seventh Day of August, 2001

*Attest:*

Nicholas P. Godici

*Attesting Officer*

NICHOLAS P. GODICI
*Acting Director of the United States Patent and Trademark Office*